US006796913B2

(12) United States Patent
Tummillo

(10) Patent No.: US 6,796,913 B2
(45) Date of Patent: Sep. 28, 2004

(54) COMBINED BALL MARK REPAIR TOOL, MULTI-SIZE CIGAR HOLDER AND RUBBER, FRICTION-FITTING BALL MARK HOLDER

(76) Inventor: Michael Tummillo, 158 Greenleaf Dr., Oak Brook, IL (US) 60533

( * ) Notice: Subject to any disclaimer, the term of this patent is extended or adjusted under 35 U.S.C. 154(b) by 0 days.

(21) Appl. No.: 10/210,145

(22) Filed: Jul. 31, 2002

(65) Prior Publication Data

US 2004/0023733 A1 Feb. 5, 2004

(51) Int. Cl.[7] ..... A63B 57/00
(52) U.S. Cl. ..... 473/408
(58) Field of Search ..... 473/406, 408, 473/286; D21/793

(56) References Cited

U.S. PATENT DOCUMENTS

| | | | | | |
|---|---|---|---|---|---|
| 1,081,501 | A | | 12/1913 | Hirsch | |
| D214,635 | S | * | 7/1969 | Reed | D21/793 |
| 3,622,157 | A | * | 11/1971 | Hatch | 473/406 |
| 3,866,749 | A | * | 2/1975 | Stainer | 473/408 |
| D243,868 | S | * | 3/1977 | Williams, Jr. | D21/793 |
| D247,686 | S | * | 4/1978 | Desjardins | D21/793 |
| D249,574 | S | * | 9/1978 | Kralevich | D21/793 |
| 4,535,987 | A | * | 8/1985 | Dikoff | 473/406 |
| D300,160 | S | | 3/1989 | Johnson | |
| 4,960,278 | A | | 10/1990 | Hainey | |
| D318,625 | S | | 7/1991 | Stowell | |
| 5,121,519 | A | * | 6/1992 | Haugom | 473/408 |
| 5,226,647 | A | * | 7/1993 | Notarmuzi | 473/286 |
| D348,402 | S | | 7/1994 | McDonald | |
| D356,358 | S | | 3/1995 | Woodruff | |
| D357,964 | S | | 5/1995 | Williams | |
| 5,645,500 | A | * | 7/1997 | Borden | 473/408 |
| D387,409 | S | | 12/1997 | Cole, Jr. | |
| D389,889 | S | * | 1/1998 | Cullen, III | D21/793 |

* cited by examiner

*Primary Examiner*—Steven Wong
(74) *Attorney, Agent, or Firm*—McAndrews, Held & Malloy

(57) ABSTRACT

A combined golf ball mark repair tool and ball mark holder tool is disclosed. The combined tool includes a body, multiple legs extending from the body for repairing a golf ball mark, and an aperture located within the body for receiving a ball mark. In one embodiment, the aperture includes an interior sidewall composed of rubber, such that the peg of a ball mark can be configured to form a friction fit within the inner sidewall. One way of forming the rubber interior sidewall is to place a rubber grommet disposed within the aperture, wherein the rubber interior sidewall comprises an interior surface of the rubber grommet. In one embodiment, the tool also includes a bottle opener, which may be formed by including a wave shaped protrusion extending from the body and a finger extending from the body in a u-shaped relationship with the protrusion. In an alternative embodiment, the tool includes a multi-sized cigar holder, including two arms attached to the body opposite the multiple legs, with each of the arms having an interior edge, an exterior edge, and a distal end. The interior edge of each of the arms comprises at least two curvilinear arcs, with one pair of the curvilinear arcs together forming a portion of a circle having a first radius of curvature. The second pair together form a portion of a circle having a second radius of curvature greater than the first radius of curvature.

24 Claims, 5 Drawing Sheets

COMBINED BALL MARK REPAIR TOOL, MULTI-SIZE CIGAR HOLDER AND RUBBER, FRICTION-FITTING BALL MARK HOLDER

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to golf ball mark repair tools and more specifically relates to golf ball mark repair tools capable of performing multiple functions.

Ball mark (or divot) repair tools are something that every golfer should carry during a round of golf. In fact, golf course managers and club professionals uniformly urge golfers to do so. The location of ball marks or divots needing repair is most often the putting green, which is also the most expensive part of most golf courses to maintain and repair. The importance of repairing ball marks is clear. A properly repaired ball mark takes about 24 hours to be restored to its pre-mark shape, while unrepaired and improperly repaired marks can take two weeks or more to be restored.

Ball markers, which indicate a ball's location, are also something every golfer should carry. Unfortunately, golfers often misplace or lose ball markers during the course of one or more rounds of golf. Past methods for retaining ball markers to ball mark repairers involved, for example, magnetizing a metal ball marker. The magnetic version often is lost or comes loose from the ball mark repairer due to shifting and movement of the ball mark repair tool in a golfer's pocket. This results in the unfortunate predicament of eliminating the dual utility of the ball mark repairer (if the ball mark is lost) or having to search through several items in the golfer's pocket to find the ball mark repairer (if the ball mark comes loose). If the magnetic ball mark is lost, it is normally very difficult to find another ball mark for use with the ball mark repair tool, as magnetic markers are normally only sold with the repair tool and non-magnetic markers with stems cannot be used. Moreover, it is difficult to make a personal statement and/or have fun with current ball marks, as they are uniform and always round in shape.

Further, many golfers smoke cigars while on the golf course. There are, however, several practical problems with smoking a cigar while golfing. First, unless one is able to hold a cigar in one's mouth while swinging a golf club, the cigar must be taken out of the mouth during a golf swing. Because ashtrays are not prevalent on the golf course, the most convenient place to put a cigar is on the ground. Due to the chemicals used on the golf course grass, however, setting the inhaling end of a cigar on the ground places the smoker at a risk ingesting these chemicals orally. Such ingestion can place the golfer at risk of getting sick, vomiting, or getting lip or gum diseases, including cancer.

Moreover, golfers often play their rounds during the morning hours, when the grass is still wet as a result of dew or watering. As a result, placing the entire cigar on the ground can get the cigar wet, thereby ruining the cigar or a portion of the tobacco in the cigar. Because of their relatively high cost, however, golfers do not wish to merely waste cigars by frequently setting them on wet ground. Moreover, the grips of golf clubs may get wet by placing them on the ground when the grass is still wet. This creates slippery grips, which are undesirable.

No prior art ball mark repair tools provide means for hold cigars, which come in many different sizes (i.e., diameters), off the ground. Nor do any prior art ball mark repair tools adequately address the problems associated with retaining a ball marker.

BRIEF SUMMARY OF THE INVENTION

Due to the shortcomings of prior ball mark repair tools, it is thus desirable to have a ball mark repair tool that is able to retain a ball marker with a friction fit, but without the risks of difficulty in removing the mark or of routine breakage of the ball mark stem.

It is also desirable to have a ball mark repair tool able to support and retain cigars, including cigars of different sizes.

A combined golf ball mark repair tool and ball mark holder is disclosed. The combined tool includes a body, multiple legs extending from the body for repairing a golf ball mark, and an aperture located within the body for receiving a ball mark. A preferred aperture includes an interior sidewall composed of rubber, such that the peg of a ball mark can be configured to form a friction fit within the inner sidewall. One way of forming the rubber interior sidewall is to place a rubber grommet disposed within the aperture, wherein the rubber interior sidewall comprises an interior surface of the rubber grommet.

In a preferred embodiment, the tool also includes a bottle opener, which is formed by including a wave shaped protrusion extending from the body and a finger extending from the body in a u-shaped relationship with the protrusion. In this embodiment, the tool also includes a spike tightener attached to the body with two nubs extending from the body in a substantially parallel relationship, being placed a lateral distance apart approximately the distance between holes in golf spikes, such that the nubs can simultaneously be inserted into such holes for affixing and removing golf spikes from shoes. Certain embodiments, such as a "pro series" model, do not have either a bottle opener or spike tightener.

In an alternative embodiment, the tool includes a multi-sized cigar holder, including two arms attached to the body opposite the multiple legs, with each of the arms having an interior edge, an exterior edge, and a distal end. The interior edge of each of the arms comprises at least two curvilinear arcs, with one pair of the curvilinear arcs together forming a portion of a circle having a first radius of curvature. The second pair together form a portion of a circle having a second radius of curvature greater than the first radius of curvature. In this way, when inserted into the ground, the tool may be used to secure and support cigars of multiple different sizes (i.e., multiple different radii). In the preferred embodiment, the legs extend from the body along a longitudinal axis of the tool, with the arms extending from the body in a y-shaped relationship with respect to the axis. In one preferred embodiment, one or more of the arms also includes a bit having a flat edge at the distal end, in different sizes if more than one is present, to enable the tool to be used as a screwdriver or a golf club groove cleaner through use of the bit.

DETAILED DESCRIPTION OF THE INVENTION

Figure 1:
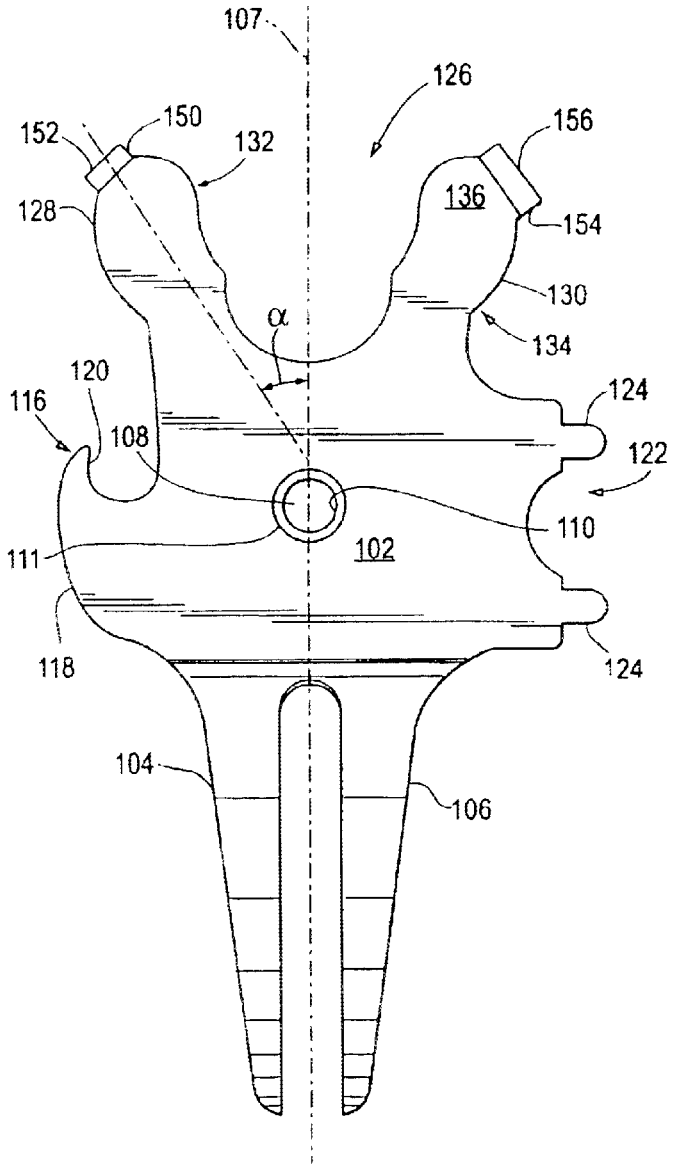
FIG. 1 presents a top plan of a ball mark repair tool according to one embodiment of the present invention.
Figure 3:
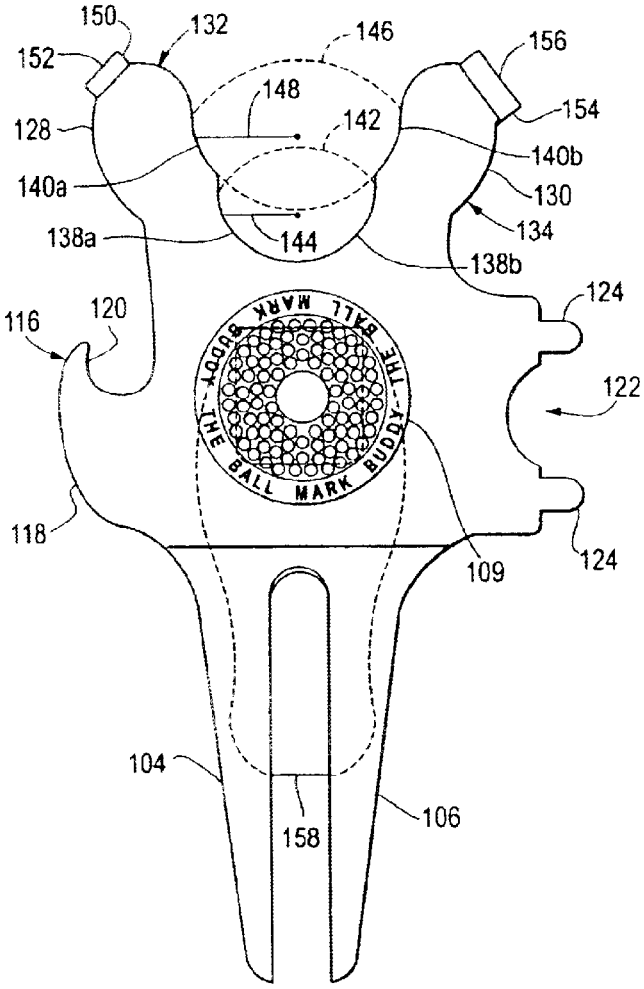
FIG. 3 presents an elevation of a ball mark repair tool according to a particular embodiment of the present invention.

In a preferred embodiment of the invention, as shown in FIGS. 1 and 3, the golf ball mark repair tool 100 incorporates a body 102 having multiple legs 104, 106 extending therefrom for repairing a golf ball mark. The legs preferably extend in a substantially parallel relationship to one another along a longitudinal axis 107, thereby making the tool 100 more capable of properly repairing a ball mark. Within the body, an aperture 108 is placed for receiving a ball mark 109. The aperture 108 includes an interior sidewall 1 10 composed of rubber. The illustrated sidewall 110 is a portion of a rubber grommet 111, which is retained by the aperture 108.

Figure 4:
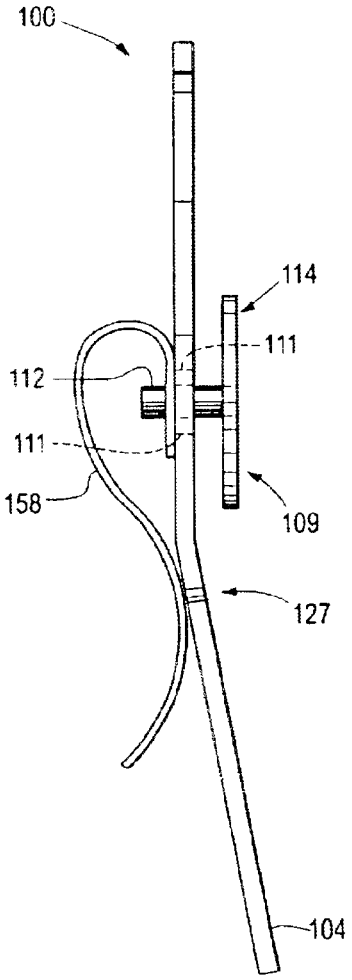
FIG. 4 presents a side view of a ball mark repair tool according to a particular embodiment of the present invention.
Figure 5:
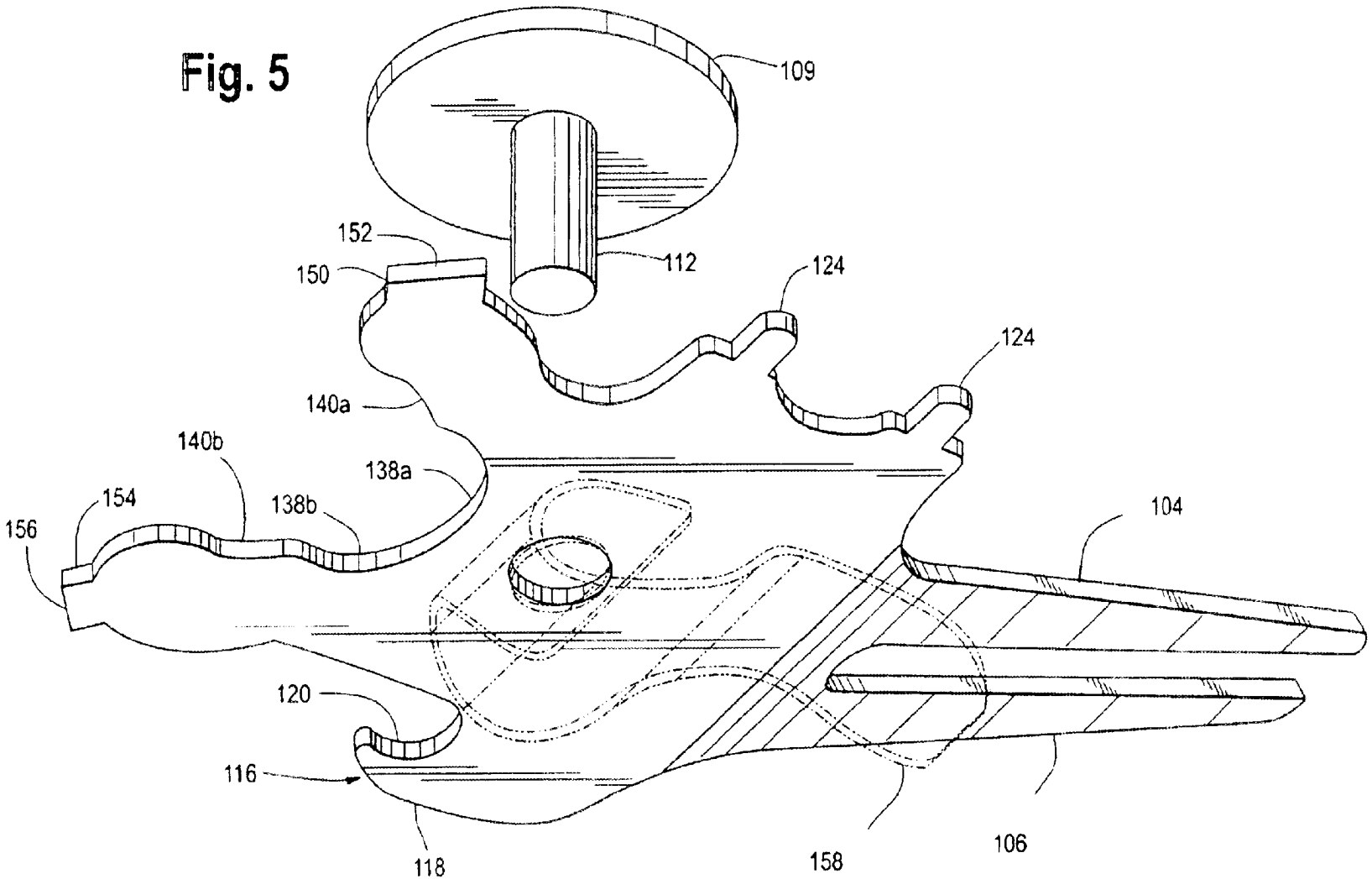
FIG. 5 presents a perspective view of a ball mark repair tool according to a particular embodiment of the present invention.
Figure 6:
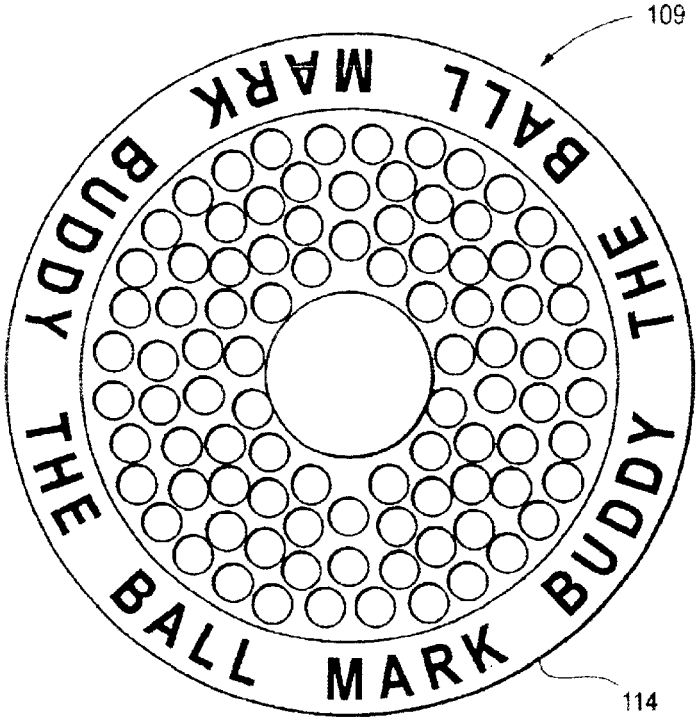
FIG. 6 presents a top plan and a side view of a ball marker according to a particular embodiment of the present invention.
Figure 6B:
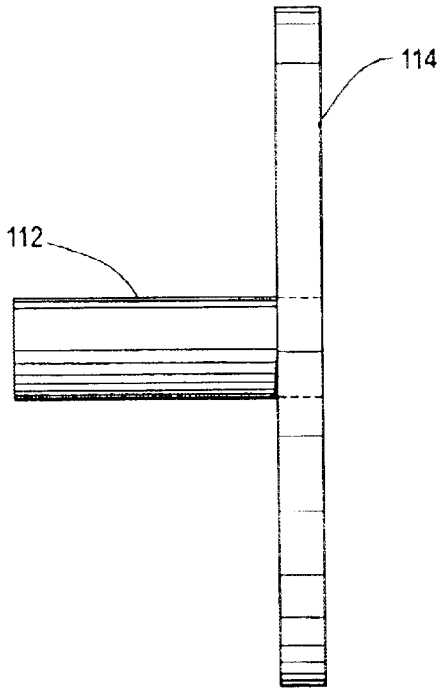

In the embodiment illustrated in FIG. 6, the ball mark 109 includes a peg or stud 112 attached to a marking surface 114. To secure the ball mark 109 to the body 102, the peg 112 is inserted into the aperture 108 by pushing on the marking surface 114. This relationship between the mark 109 and body 102 is illustrated in FIGS. 3–5. Because a rubber grommet 111 is used, ball markers are more likely to be retained by the tool. An exemplary ballpark 109 can be formed from a steel stud 0.125 inches in diameter affixed to a sheet metal marking surface. One preferred material for forming the marking surface 114 is full hard stainless steel that is laser cut. A preferred range of thicknesses for the marking surface 114 is 0.028"–0.036". For example, one preferred thickness for the marking surface is 0.030".

By using a steel stud and laser cutting the marking surface, the ball mark can be formed in one of many different custom selected shapes, for example in the form of a football, hockey sticks, scales of justice, etc. Because of its size and stiffness, the stud 112 is usable to poke a hole in a cigar (not shown) to prepare it for smoking, e.g., by creating a passageway through the cigar's leaf wrap at the unlit end of the cigar. Other materials from which the marking surface may be made include copper, brass and gold. The marking surface may also be coated with any one of these materials (e.g., made from stainless steel and coated with gold).

Looking again at FIGS. 1 and 3, the illustrated tool 100 includes a bottle opener 116. The illustrated bottle opener includes a wave shaped protrusion 118 and a finger 120 extending from the body 102 in a u-shaped relationship. Between the finger 120 and wave shaped protrusion 118, the u-shape may be utilizes to retain a cigarette through, for example, a friction fit. In this way, the tool 100 can support a cigarette during a round of golf without getting wet or set on the ground. The illustrated tool also includes a spike tightener 122 with multiple nubs 124 (two shown in the drawing Figures) for securing and removing spikes and/or cleats to and from golf shoes.

The illustrated tool also includes a multi-sized cigar holder 126. The exemplary holder 126 illustrated in FIGS. 1 and 3 is composed of first and second arms 128, 130 attached to the body 102 opposite the multiple legs 104, 106. The arms 128, 130 extend in a y-shaped relationship with respect to the tool's longitudinal axis 107. The angle $\alpha$ at which the arms extend is preferably an inclined angle with respect to the longitudinal axis 107. When the angle $\alpha$ is the same for both arms, the cigar holder 126 is symmetrical about the longitudinal axis.

Figure 2:
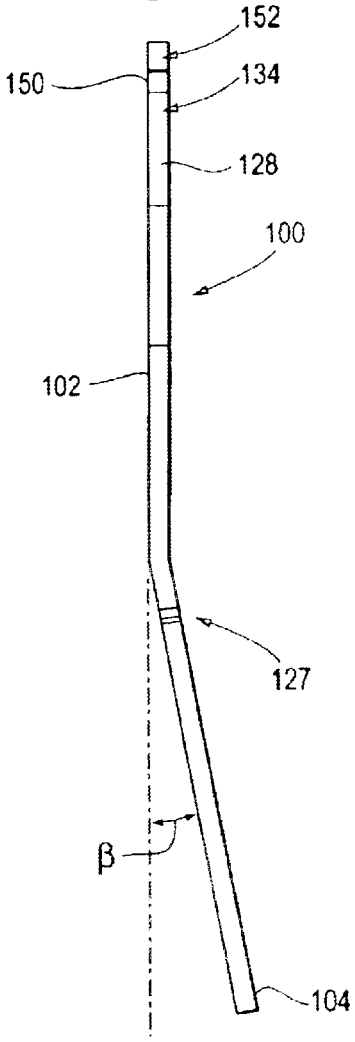
FIG. 2 presents two side views of a ball mark repair tool according to a particular embodiment of the present invention.
Figure 2A:
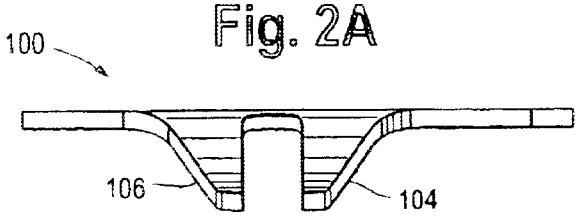

As can be seen from FIG. 2, the illustrated body 102 of the tool lies along a single plane. The legs 104, 106, however, preferably extend from the body 102 at an inclined angle $\beta$ with respect to the plane in which the body resides. In this way, the tool 100 is ergonomically designed to fit in the hand properly, easier for golfers to use, and more effective at repairing ball marks. For example, the golfer's hand can stay further from the ground (i.e., in a more comfortable position) than if the legs 104, 106 resided in the same plane as the body 102. One angle that can be used as the inclined angle $\beta$ is 20°.

In an alternative embodiment illustrated in FIGS. 2 and 4, the tool 100 includes a thumb pocket 127. The illustrated thumb pocket 127 includes an impression in the body 102 of the tool. During use, the thumb pocket is engaged by the user's thumb to enable better leverage and provide a still further more ergonomic and comfortable fitting tool within the user's hand.

Referring again to FIGS. 1 and 3, the arms 128, 130 of the preferred cigar holder 126 each include an interior edge 132, exterior edge 134 and a distal end 136. The interior edge 132 of each arm includes a first curvilinear arc 138*a–b* and a second curvilinear arc 140*a–b*. In order to hold cigars in place, the pair of first arcs 138*a–b* form a portion of a circle 142 having a first radius of curvature 144 and the pair of second arcs 140*a–b* form a portion of a circle 146 having a second radius of curvature 148. In order to keep the grip of a club off of the ground, for example when the ground is wet, the golf grip may be laid horizontally along the ground, with the two tallest points of the "Y" shaped surface supporting the grip.

It can therefore be seen that, during use, a cigar may be placed in between either the first or second arcs. It is preferred that the cigar be placed parallel to the surface of the ground (i.e., perpendicular to the tool's longitudinal axis 107), although it may also be placed at an angle. When placed at an angle, the lit end is placed toward the ground and the inhaling end away from the ground such that the inhaling end is protected from infestation by any chemicals present on the ground. Moreover, when the cigar is placed at an angle, any effect moisture on the ground has on the lit end is minimized.

The tool 100 can thus be used to support a cigar having a radius of curvature matching either the first or second radii. Indeed, a cigar having a radius of curvature in between the first and second radii 144, 148 may still be supported through use of the second arcs 140*a–b*, albeit not as securely as when the radius of the cigar matches exactly the radius of curvature of one of the tool's radii. Exemplary radii for use are those that would support cigars of sizes 0.625 inches and 0.750 inches in diameter, i.e., radii of 0.3175 inches and 0.375 inches. In a preferred embodiment, the radii 144, 148 are of such size that cigars can be press fit therein, to avoid harming the cigar wrapper. Of course, more than two pairs of arcs may be present (not shown), to enable the tool 100 to be used with even more than two different sized cigars.

In order to add further functional capability to the tool, the first arm 128 illustrated in the drawing Figures includes a bit 150 with a flat edge 152 at the distal end. In this manner, the tool may also be used as a screwdriver and/or a golf club groove cleaner. The illustrated second arm 130 also includes a bit 154 with a flat edge 156. By making the flat edges 152, 156 different in length, the tool 100 may be used as a multi-sized screwdriver or a multi-sized golf club groove cleaner through the use of the bits 150, 154. In one embodiment, the flat edges 152, 156 are sized to form #4 and #8 screwdriver bits. A further advantage of the present tool 100 is that it can perform the functions described with no need for moving parts and no need to open a portion of the device to access the tool's features.

Figure 7A:
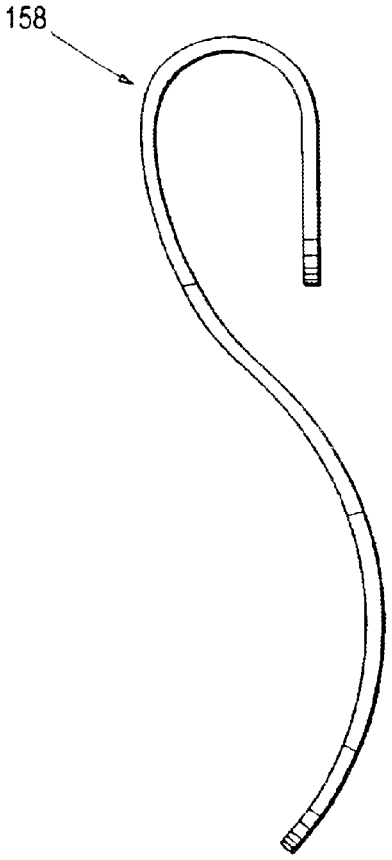
FIG. 7 presents a diagrammatical top plan and a side view of a clip according to a particular embodiment of the present invention.
Figure 7:
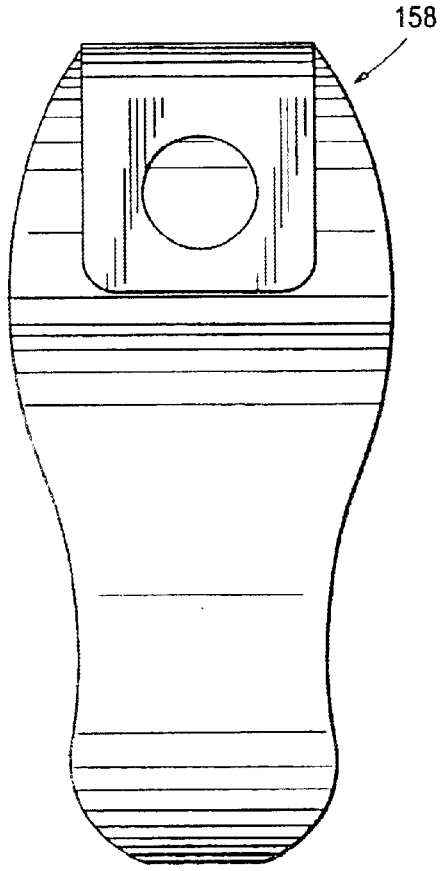

Turning to FIGS. 4 and 7, the tool 100 illustrated there includes a clip 158 for securing the tool 100 to a pocket or the like. In a preferred embodiment, the tool 100, including the clip 158, is made of stainless steel for lifetime rust resistance. The tool 100 itself may be formed as one integral unit, but is preferably formed as separate component parts welded or secured together. The preferred tool 100 is made from sheet metal, which generally requires that the tool be formed from multiple components. While a preferred tool 100 is made from 300 Series full hard stainless steel sheet metal, it may also be made from other types of colled rolled steel. Overall, it is preferred that the tool 100 is made strong enough so that it will not bend, e.g., by using one of the hardest materials without post or secondary heat treatment, full hard stainless. The exemplary clip 158 shown in FIGS. 4 and 7 is secured to the tool 100 by spot welding.

While particular embodiments of the invention have been shown, it will be understood, of course, that the invention is not limited thereto since modifications may be made by those skilled in the art, particularly in light of the foregoing teachings. For example, preferred thicknesses of the material from which the tool is made include 0.060" and any thickness in the range of 0.040"–0.080", but the invention is not limited thereto. It is, therefore, contemplated that the appended claims will cover any such modifications as incorporate those features that constitute the essential features of these improvements within the true spirit and the scope of the invention.

What is claimed is:

1. A combined golf ball mark repair tool and ball marking tool comprising:

a body;

multiple legs extending from said body for repairing a golf ball mark, at least two of which extend in a substantially parallel relationship to one another;

an aperture located within said body for receiving a ball mark, said aperture comprising an interior sidewall composed of rubber, said ball mark comprising a peg perpendicularly attached to a substantially flat marking surface, wherein said peg is configured to form a friction fit within said inner sidewall; and a multi-sized cigar holder comprising:

first and second arms attached to said body opposite said multiple legs, each of said arms having an interior edge, an exterior edge, and a distal end, wherein the interior edge of each of the arms comprises at least first and second curvilinear arcs, wherein said first curvilinear arc of said first arm and said first curvilinear arc of said second arm form a portion of a circle having a first radius of curvature of approximately 5/16 inches, and wherein said second curvilinear arc of said first arm and said second curvilinear arc of said second arm form a portion of a circle having a second radius of curvature of approximately 3/8 inches.

2. The tool of claim 1 further comprising a rubber grommet disposed within said aperture, wherein said rubber interior sidewall comprises an interior surface of said rubber grommet.

3. The tool of claim 1 further comprising a bottle opener.

4. The tool of claim 3 wherein said bottle opener comprises a wave shaped protrusion extending from said body and a finger extending from said body in a u-shaped relationship with said protrusion.

5. The tool of claim 1 further comprising a spike tightener attached to said body.

6. The tool of claim 5 wherein said spike tightener comprises two nubs extending from said body in a substantially parallel relationship, being disposed a lateral distance apart approximately the distance between holes in golf spikes, such that said nubs can simultaneously be inserted into said holes for affixing and removing golf spikes from shoes.

7. The tool of claim 1 wherein said legs extend from said body along a longitudinal axis of the tool and said arms extend from said body in a y-shaped relationship with respect to said longitudinal axis.

8. The tool of claim 1 wherein said legs extend from said body along a longitudinal axis of the tool and each of said arms extend from said body at an inclined angle with respect to said longitudinal axis.

9. The tool of claim 1 wherein at least the said first arm includes a bit having a first flat edge disposed at said distal end of said first arm, thereby enabling said tool to be used as a screwdriver or a golf club groove cleaner through use of said bit.

10. The tool of claim 9 wherein said second arm includes a bit having a second flat edge disposed at said distal end of said second arm, said second flat edge being longer than said first flat edge, thereby enabling said tool to be used as a multi-sized screwdriver or a multi-sized golf club groove cleaner through use of said bits.

11. The tool of claim 1 wherein said body comprises a concave indentation for receiving a user's thumb.

12. A golf ball mark repair tool and ball marking tool comprising:

a body;

multiple legs extending from said body for repairing a golf ball mark, at least two of which extend in a substantially parallel relationship to one another;

an aperture located within said body for receiving a ball mark; and a multi-sized cigar holder comprising first and second arms attached to said body opposite said multiple legs, each of said arms having an interior edge, an exterior edge, and a distal end, wherein the interior edge of each of the arms comprises at least first and second curvilinear arcs, wherein said first curvilinear arc of said first arm and said first curvilinear arc of said second arm form a portion of a circle having a first radius of curvature of approximately 5/16 inches, and wherein said second curvilinear arc of said first arm and said second curvilinear arc of said second arm form a portion of a circle having a second radius of curvature of approximately ⅜ inches.

13. The tool of claim 12 wherein said legs extend from said body along a longitudinal axis of the tool and said arms extend from said body in a y-shaped relationship with respect to said longitudinal axis.

14. The tool of claim 12 wherein said legs extend from said body along a longitudinal axis of the tool and each of said arms extend from said body at an inclined angle with respect to said longitudinal axis.

15. The tool of claim 12 wherein at least the said first arm includes a bit having a first flat edge disposed at said distal end of said first arm, thereby enabling said tool to be used as a screwdriver or a golf club groove cleaner through use of said bit.

16. The tool of claim 15 wherein said second arm includes a bit having a second flat edge disposed at said distal end of said second arm, said second flat edge being longer than said first flat edge, thereby enabling said tool to be used as a multi-sized screwdriver or a multi-sized golf club groove cleaner through use of said bits.

17. The tool of claim 12 wherein said aperture comprises an interior sidewall composed of rubber, wherein said peg is configured to form a friction fit within said inner sidewall.

18. The tool of claim 17 further comprising a rubber grommet disposed within said aperture, wherein said rubber interior sidewall comprises an interior surface of said rubber grommet.

19. The tool of claim 12 further comprising a bottle opener.

20. The tool of claim 19 wherein said bottle opener comprises a wave shaped protrusion extending from said body and a finger extending from said body in a u-shaped relationship with said protrusion.

21. The tool of claim 12 further comprising a spike tightener attached to said body.

22. The tool of claim 21 wherein said spike tightener comprises two nubs extending from said body in a substantially parallel relationship, being disposed a lateral distance apart approximately the distance between holes in golf spikes, such that said nubs can simultaneously be inserted into said holes for affixing and removing golf spikes from shoes.

23. The tool of claim 12 wherein said body, legs and cigar holder are composed of stainless steel.

24. The tool of claim 12 wherein said body comprises a concave indentation for receiving a user's thumb.

* * * * *